US006674628B1

(12) United States Patent
Wohlfarth

(10) Patent No.: US 6,674,628 B1
(45) Date of Patent: Jan. 6, 2004

(54) PULSE-WIDTH MODULATED RELAY

(75) Inventor: Paul Dana Wohlfarth, Vernonia, OR (US)

(73) Assignee: Credence Systems Corporation, Fremont, CA (US)

( * ) Notice: Subject to any disclaimer, the term of this patent is extended or adjusted under 35 U.S.C. 154(b) by 192 days.

(21) Appl. No.: 10/057,560

(22) Filed: Jan. 25, 2002

(51) Int. Cl.[7] ..... H01H 47/04
(52) U.S. Cl. ..... 361/153; 361/152; 361/154
(58) Field of Search ..... 361/153, 154, 361/152, 139, 143, 144, 146, 160, 159, 170

(56) References Cited

U.S. PATENT DOCUMENTS 4,328,525 A * 5/1982 Allen et al. ..... 361/152
5,381,297 A * 1/1995 Weber ..... 361/153
5,510,951 A * 4/1996 Briedis et al. ..... 361/154
6,249,418 B1 * 6/2001 Bergstrom ..... 361/152

* cited by examiner

*Primary Examiner*—Anthony Dinkins
(74) *Attorney, Agent, or Firm*—Daniel J. Bedell; Smith-Hill and Bedell

(57) ABSTRACT

A relay controller intermittently connects a power supply across a relay coil with a controlled duty cycle whenever the relay coil is to generate a magnetic field for opening or closing the relay's contacts. The duty cycle with which the controller connects the power supply across the coil controls limits a steady-state amplitude of current passing through the coil, thereby controlling the intensity of the magnetic field the coil generates.

35 Claims, 8 Drawing Sheets

PULSE-WIDTH MODULATED RELAY

BACKGROUND OF THE INVENTION

1. Field of the Invention

The present invention relates in general to relays and in particular to a relay having a pulse-width modulated control voltage.

2. Description of Related Art

Figure 1:
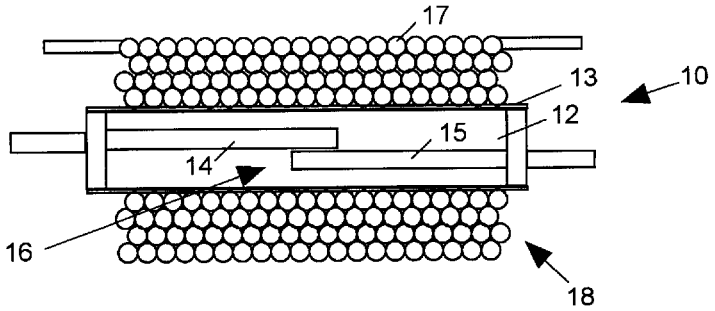
FIG. 1 (PRIOR ART)

FIG. 1 is a simplified sectional elevation view of a typical prior art normally open relay 10 including a glass tube 12 containing a pair of conductive reeds 14, 15 serving as the relay's contacts 16 for selectively providing a signal path between two circuit nodes. A wire 17 wrapped many turns around tube 12 forms a coil 18. Reeds 14, 15 are normally spaced apart, but when a current passes through coil 18, coil 18 produces magnetic flux causing reed 14 to contact reed 15 so that a current may flow through the relay contacts 16.

Figure 2:
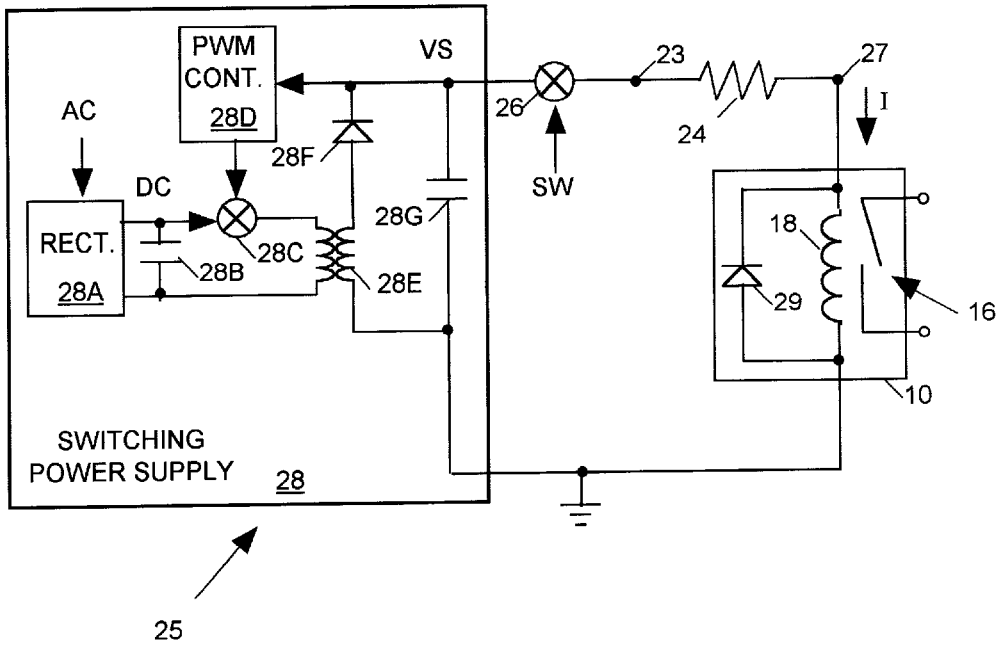
FIG. 2 (PRIOR ART)

FIG. 2 is a schematic diagram illustrating a typical relay control system 25 for driving relay 10. Control system 25 includes a switching power supply 28 that can produce a DC signal VS of a desired voltage from an AC signal. As illustrated in FIG. 2, power supply 28 includes a rectifier 28A and capacitor 28B for converting the AC signal to a high voltage DC signal. A switch 28C controlled by a pulse width modulation circuit (PWM) 28D couples the DC signal across the primary winding of a transformer 28E. The transformer's secondary winding is connected across a diode 28F and a capacitor 28G. The power supply's DC output voltage VS developed across capacitor 28G is a function of the duty cycle with which pulse PWM circuit 28D closes switch 28C. PWM circuit 28D monitors VS and adjusts the duty cycle to keep VS at a desired level.

Relay control system 25 also includes a switch 26 linking a power supply 28 to a circuit node 23. A limiting resistor 24 links node 23 to a node 27. Relay coil 18 is connected between node 27 and ground. (Limiting resistor 24 may be a separate discrete component as shown in FIG. 2 or may be implemented as the resistance of the wires forming coil 18.) Relay 10 includes a diode 29 connected across coil 18. When signal SW is applied, switch 26 closes, a current I begins to flow in coil 18 and power supply 28 begins to supply energy to coil 18 and resistor 24 at a constant rate. Initially, current I is very low and resistor 24 dissipates little of the energy output of power supply 28. Coil 18 stores most of the energy output of power supply 28 in a magnetic field. However the current is proportional to the strength of the coil's magnetic field and the strength of the coil's magnetic field is proportional to the amount of energy stored in the field. Hence the coil current increases and the magnetic field becomes stronger as coil 18 continues to receive energy from supply 28 and store it in the magnetic field.

The rate at which resistor 24 dissipates energy supplied by power supply 28 is proportional to $I^2R$, where R is the resistor's resistance. Little current passes through resistor 24 when switch 26 initially closes and therefore coil 18 stores little energy in its magnetic field. Therefore resistor 24 initially dissipates little of the energy produced by supply 28. However as coil 18 begins to store increasing amounts of energy in its magnetic field, it permits an increasing amount of current I to flow through resistor 24, and the resistor begins to dissipate an increasing proportion of the output energy of power supply 28. Coil 18 stops adding energy to the magnetic field when coil current I reaches a substantially constant steady state level $I_{ss}$ after all initial transients or fluctuating conditions have settled. At that point resistor 24 will dissipate all of the energy being produced by supply 28. The resistance of resistor 24 (in combination with the inherent resistances of coil 18, switch 26 and supply 28) limits the steady state level $I_{ss}$ at which the coil current I levels off after switch 26 closes. Resistor 24 therefore acts as a "current limiting" resistor inserted into the circuit to limit the flow of current, thereby preventing excessive current from damaging other parts of the circuit.

When switch 26 opens, the magnetic field surrounding coil 18 continues to induce a current I within coil 18 and there is no instantaneous change in its amplitude. However rather than circulating in the loop including coil 18, supply 28, switch 26 and resistor 24, coil current I instead circulates in the loop including coil 18 and the diode 29 connected across the coil's terminals. As the inherent resistances of diode 29 and coil 18 dissipate the energy stored in the magnetic field, the field collapses and the coil current amplitude tapers off to zero.

The intensity of the magnetic field coil 18 produces is proportional to the product of the amplitude of the current passing through coil 18 and the number of turns of the coil about tube 12. A typical relay coil 18 will include a large number of turns to minimize the amount of steady state current $I_{ss}$ needed to operate relay 10 because this also minimizes the power resistor 24 dissipates. The power P that resistor 24 dissipates in response to the steady state current is as follows:

$$P=I_{ss}^2R \qquad [1]$$

By doubling the number of coil turns we can reduce the required steady state current $I_{ss}$ while still maintaining the same steady state field intensity. To reduce $I_{ss}$, we double R. While equation [1] tells us doubling R increases power dissipation by a factor of two, it also tells us that reducing $I_{ss}$ in half decreases power dissipation by a factor of four. Thus, the net effect of doubling the number of coil turns and doubling the size of resistor 24 is to cut the resistor's power dissipation in half. Hence to reduce power consumption, relay coils typically have many turns. However as we add turns to a relay coil, we not only add to the cost of making the relay, we also add to the relay's physical size. A relay's coil typically contributes more than half of its thickness.

Thick relays can be problematic in applications where large numbers of relays must be packed into a small volume. For example, an integrated circuit (IC) tester typically uses relays to route signals between test circuits and terminals of an IC device under test (DUT). It is helpful to position the test circuits as closely as possible to the DUT terminals so that signal paths between the test circuits and the DUT's input/output terminals are very short. Since a large number of relays must reside between the test circuits and the DUT, we want to be able to pack as many relays as possible into a small space. However since relays having many turns are thick, large numbers of them cannot be packed into a small space.

We could use thin relays having fewer coil turns, but as discussed above, conventional controllers for such relays would generate substantial amounts of heat in their current limiting resistance. Therefore what is needed is a relay controller that can drive a high current relay having relatively few coil turns without incurring substantial power loss in current limiting resistance.

BRIEF SUMMARY OF THE INVENTION

The present invention is directed to a relay controller using pulse-width modulation to control the current in a relay coil. Rather than continuously linking a power supply to a relay coil and using resistance to limit coil current when a control signal indicates the relay coil is to produce the magnetic field, a relay control system in accordance with the invention intermittently connects the power supply to the coil with a controlled frequency and duty cycle. No current limiting resistor is required because the frequency and duty cycle with which the power supply is connected to the coil limits the steady-state amplitude of the current passing through the coil.

In some embodiments of the invention the frequency and duty cycle with which the power supply is connected to the relay coil is fixed to a level that keeps the coil current within a steady state range for which the magnetic field intensity is sufficient to operate the relay coils. In other embodiments of the invention, the controller monitors the coil current and adjusts the duty cycle with which the power supply is connected to the relay to keep the coil current in the appropriate range.

Since a relay controller in accordance with the invention does not rely on current limiting resistance in series with the relay coil, the relay controller dissipates energy at a relatively low rate, even when the coil has very few turns and requires a high steady state current to produce a magnetic field of sufficient intensity. Having relatively few turns in its coil, a relay driven by a relay control system in accordance with the invention can be compact and inexpensive to fabricate.

The claim(s) appended to this specification particularly point out and distinctly claim the subject matter of the invention. However those skilled in the art will best understand both the organization and method of operation of what the applicant(s) consider to be the best mode(s) of practicing the invention, together with further advantages and objects of the invention, by reading the remaining portions of the specification in view of the accompanying drawing(s) wherein like reference characters refer to like elements.

BRIEF DESCRIPTION OF THE DRAWING(S)

Figure 3:
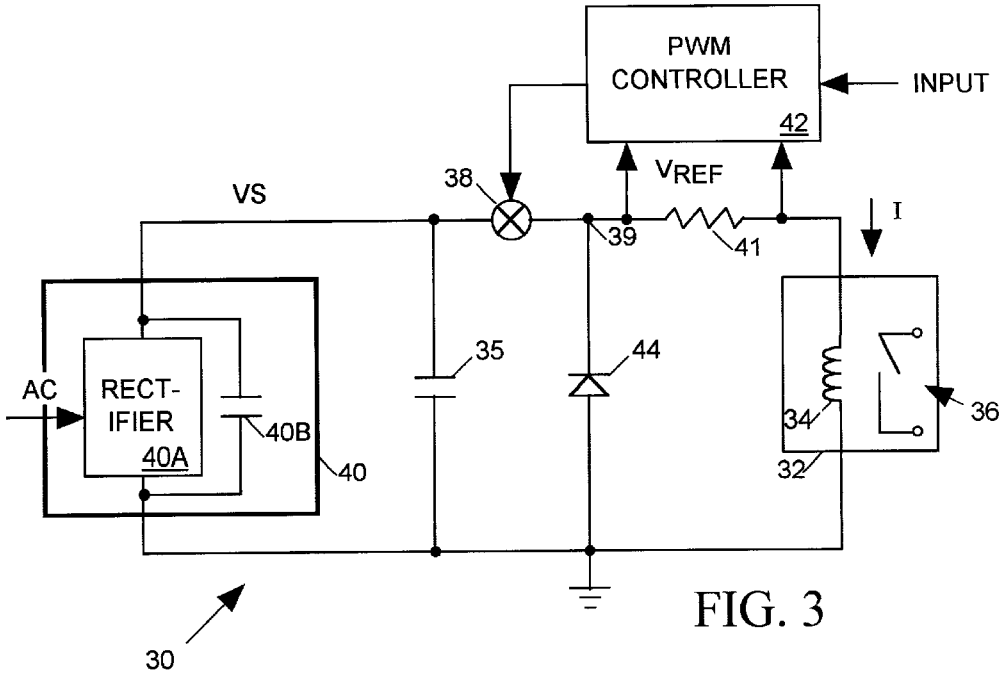
Figure 4:
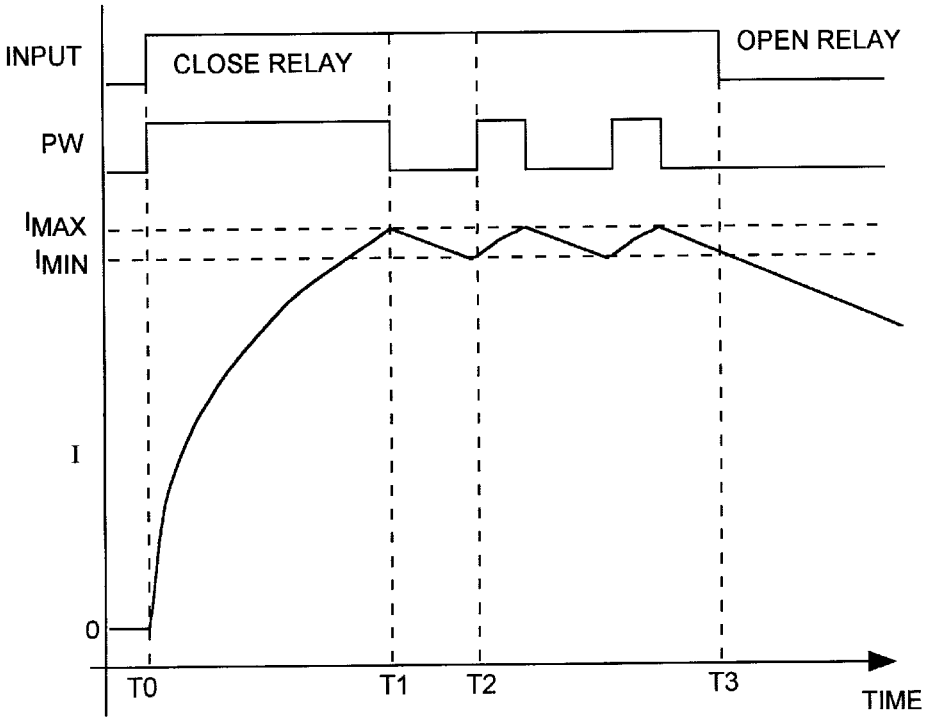
Figure 5:
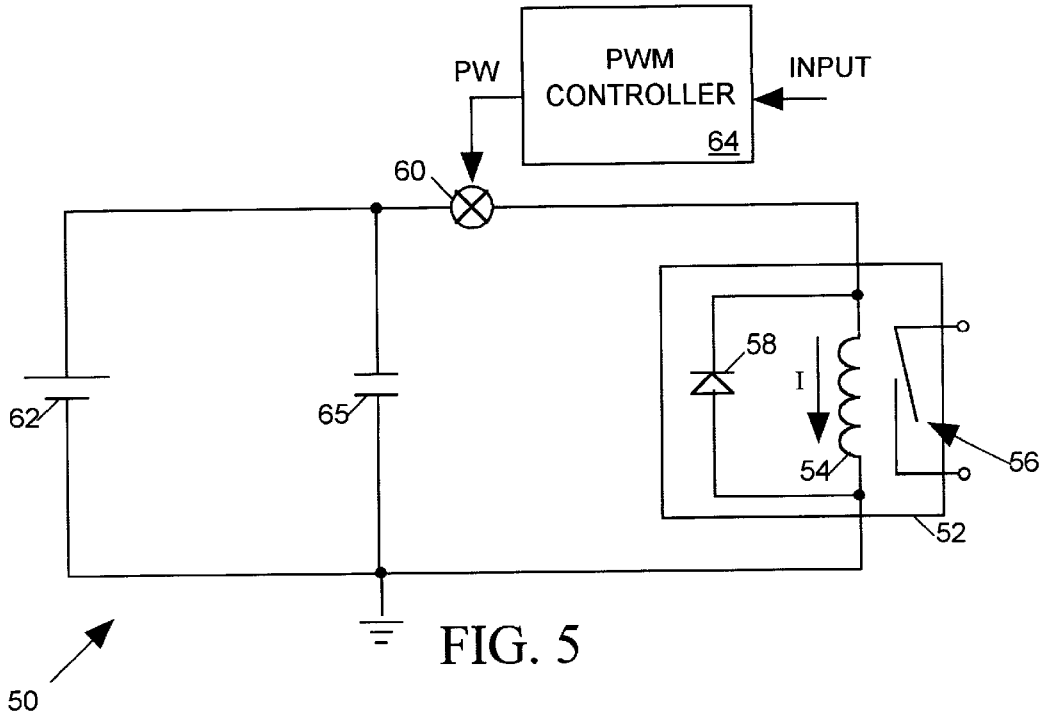
Figure 6:
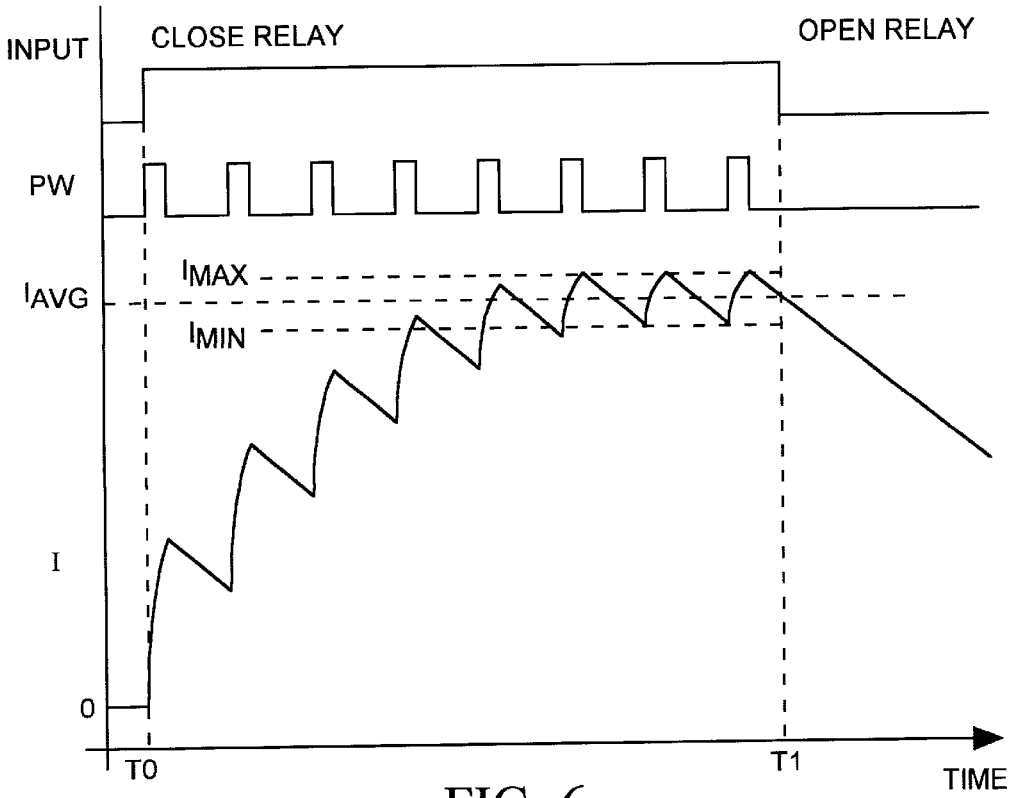
Figure 9:
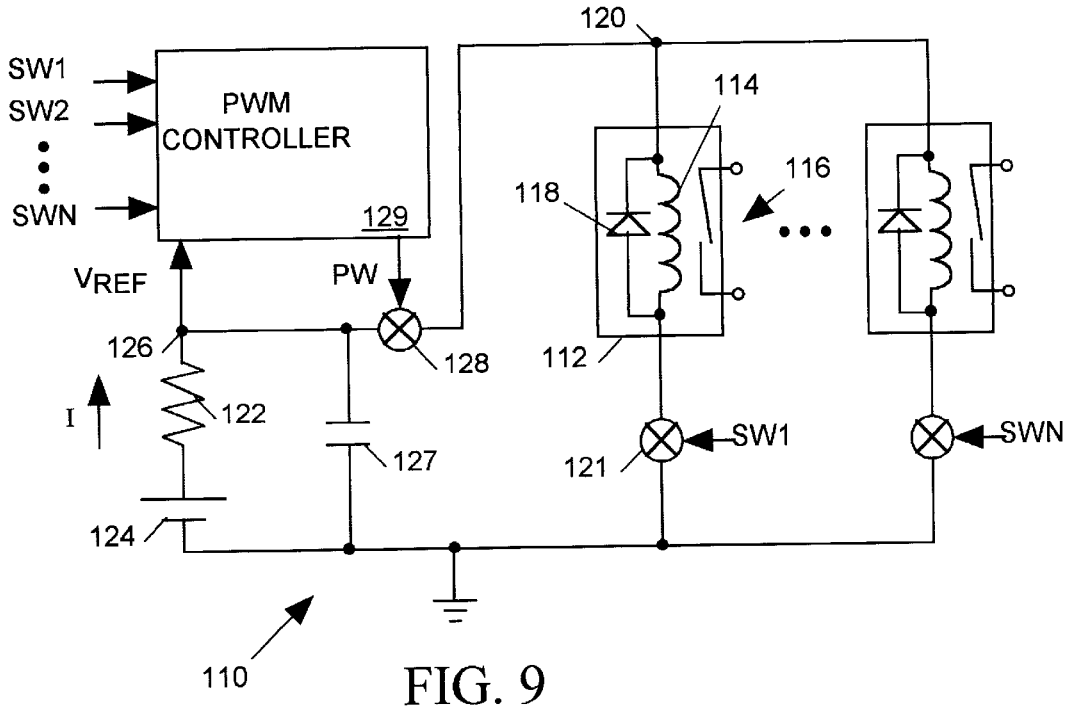
Figure 10:
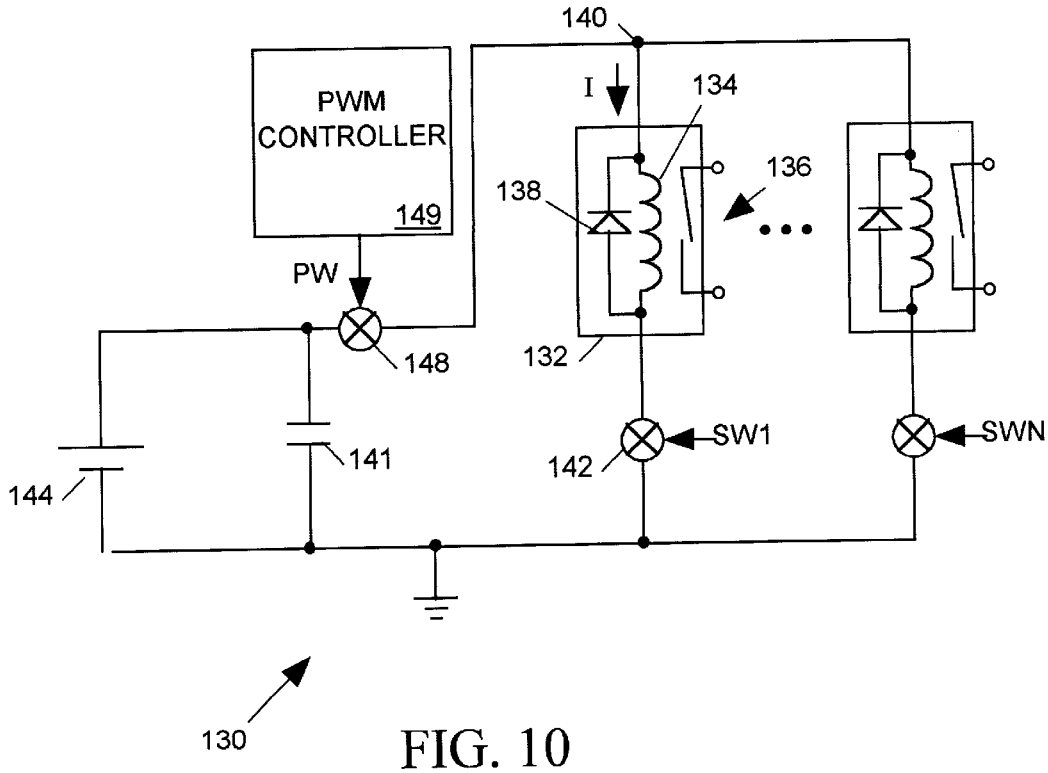
Figure 11:
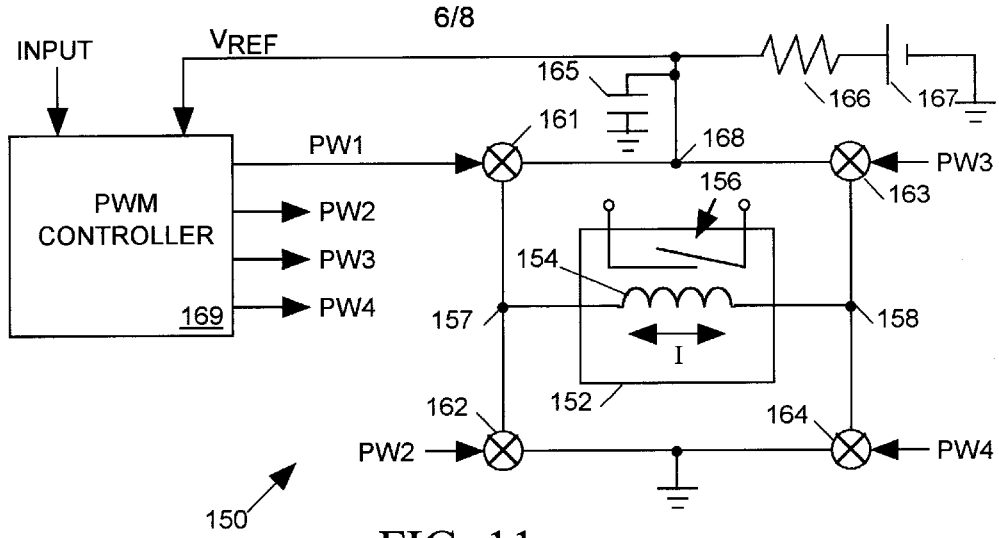
Figure 12:
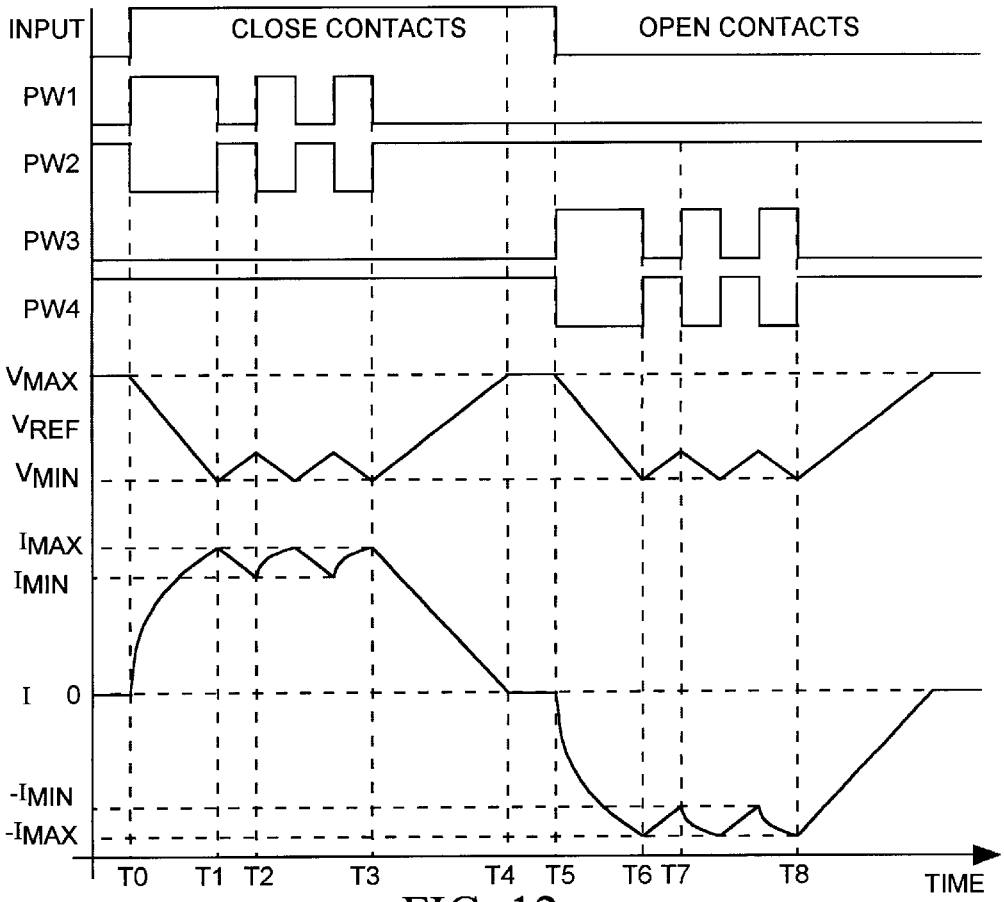
Figure 13:
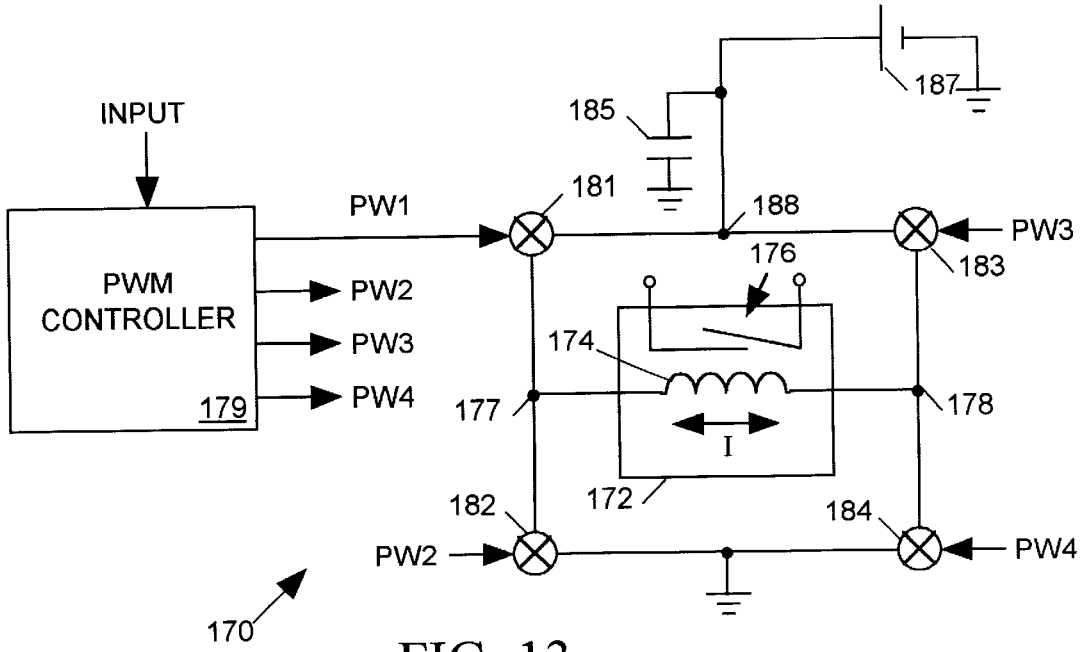
Figure 14:
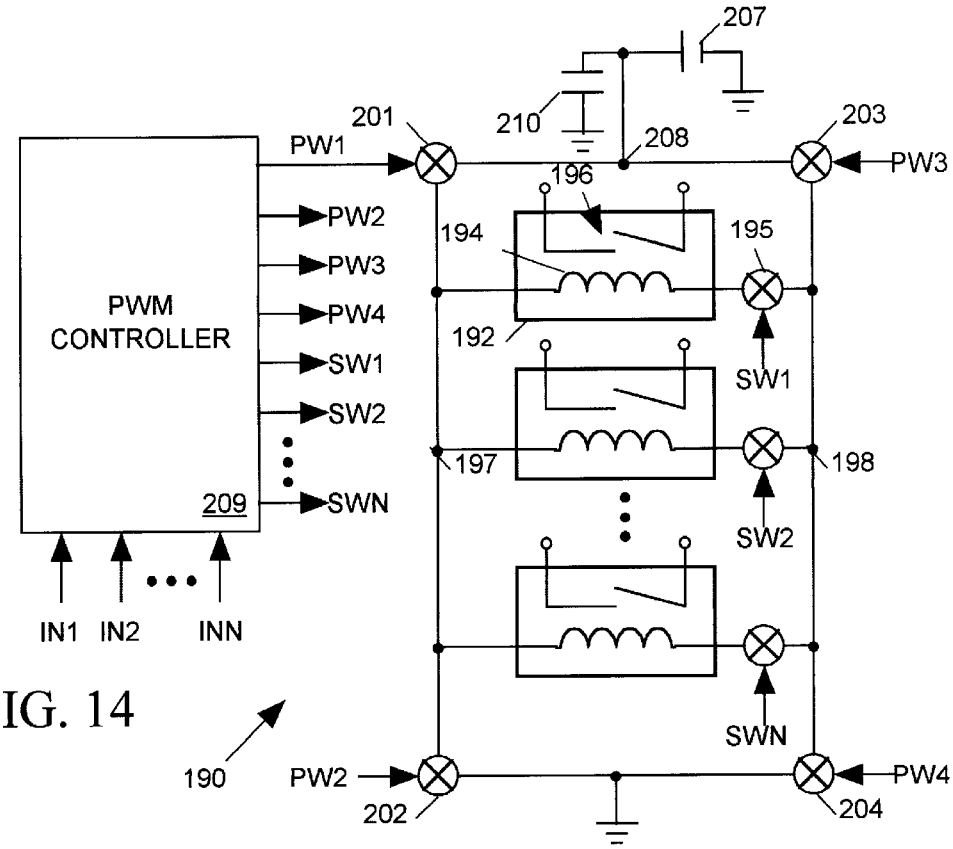
Figure 15:
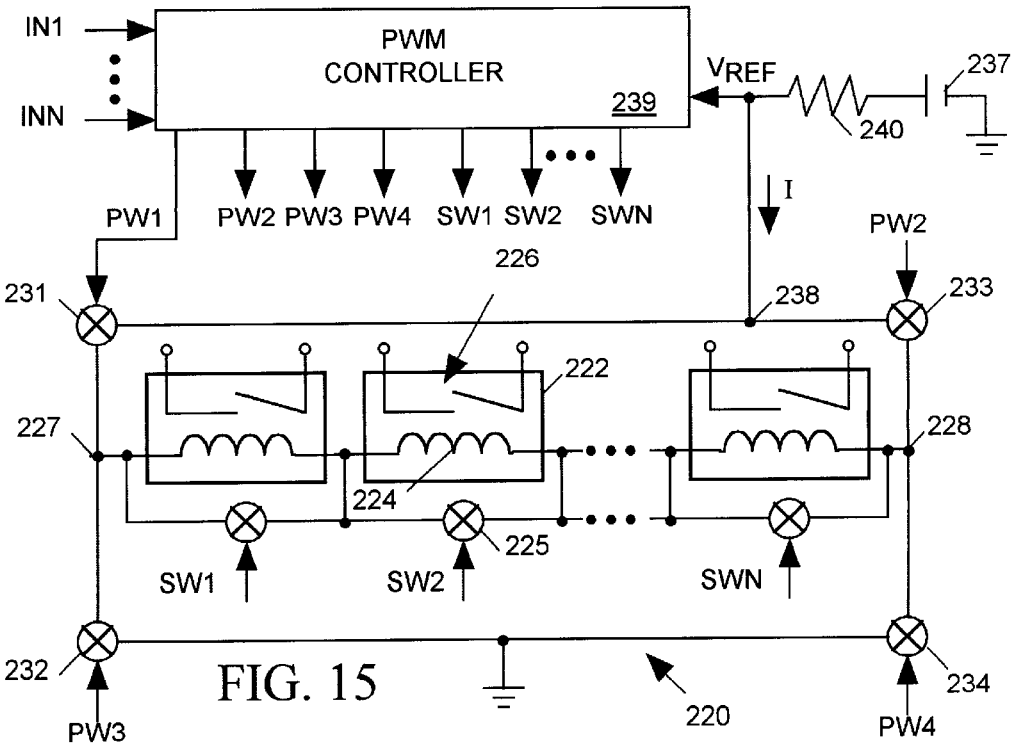

FIG. 1 is a simplified sectional elevation view of a typical prior art reed relay, FIG. 2 is a schematic diagram illustrating a prior art circuit for controlling the relay of FIG. 1, FIG. 3 is a schematic diagram illustrating a circuit in accordance with the invention for controlling a single non-latching relay, FIG. 4 is a timing diagram illustrating behavior of signals of the control system of FIG. 3, FIG. 5 is a schematic diagram illustrating a circuit in accordance with the invention for controlling a non-latching relay, FIG. 6 is a timing diagram illustrating behavior of various signals of the relay control system of FIG. 5, FIGS. 7–10 are schematic diagrams illustrating circuits in accordance with the invention for controlling several non-latching relays, FIG. 11 is a schematic diagram illustrating a circuit in accordance with the invention for controlling a single latching relay, FIG. 12 is a timing diagram illustrating behavior of various signals of the circuit of FIG. 11, FIG. 13 is a schematic diagram illustrating a circuit in accordance with the invention for controlling a single latching relay, and FIGS. 14 and 15 are schematic diagrams illustrating circuits in accordance with the invention for controlling several latching relays.

DETAILED DESCRIPTION OF THE INVENTION

The present invention is directed to a relay controller using pulse-width modulation to control the current in a relay coil, and this specification describes several exemplary embodiments and applications of the invention considered to be the best modes of practicing the invention.

A typical relay includes a coil for producing a magnetic field when a voltage is applied across the coil and contacts that open or close in response to the magnetic field. A typical prior art relay controller includes a power supply and a switch operated by a control signal for continuously linking the power supply to the coil when the coil is to generate its magnetic field. Since the magnetic field produced by the coil is proportional to the product of the number of turns N of the coil and the current I passing through the coil, a prior art relay controller must include substantial resistance in the path between a power supply and the coil to limit the amount of current passing though the coil when the coil's magnetic field reaches a steady state level sufficient to operate the contacts. Since the current limiting resistance dissipates energy at a rate proportional to the square of the current passing through the coil, prior art relays typically employ coils having a large number of turns to reduce the amount of current the coil needs to maintain a magnetic field of sufficient intensity. This helps to reduce losses in the limiting resistance. However coils having a large number of turns are bulky and expensive to fabricate.

Rather than continuously linking a power supply to a relay coil when a control signal indicates the relay coil is to produce the magnetic field, a relay control system in accordance with the invention intermittently connects a power supply to the coil with a controlled frequency and duty cycle. No current limiting resistance is required because the frequency and duty cycle with which the power supply is connected to the coil limits the steady-state amplitude of the current passing through the coil. Since it does not require current limiting resistance, the control system dissipates energy at a relatively low rate, even when the coil has very few turns and requires a high steady state current to produce a magnetic field of sufficient intensity. Having relatively few turns in its coil, a relay driven by a power efficient relay control system in accordance with the invention can be compact and inexpensive to fabricate.

Contacts of a normally open, non-latching relay remain closed only while in presence of the magnetic field, while contacts of a normally closed, non-latching relay remain open only while in the presence of the magnetic field. In a latching relay, a coil produces a magnetic field pulse of one polarity to close the contacts and produces a magnetic field pulse of another polarity to open the contacts. The coil need not produce a continuous magnetic field to keep the contacts either opened or closed. As described in detail below, a pulse-width modulating relay control system in accordance with the invention can be used in connection with either latching or non-latching relays. A pulse-width modulating control system in accordance with the invention can also be used to concurrently control coils of more than one latching or non-latching relay connected either in series or in parallel.

Feedback Control of Non-latching Relay

FIG. 3 is a schematic diagram illustrating a control system 30 for driving a single, normally open, non-latching relay 32 including a coil 34 and contacts 36. Contacts 36 close to selectively provide a signal path between two circuit nodes when coil 34 produces a magnetic field of a sufficiently high minimum intensity. (Alternatively, relay 32 could be a normally closed relay that operates to open contacts 36 when coil 34 generates the magnetic field.)

Control system 30 includes a power supply 40 for generating a DC output voltage VS. Power supply 40 may be any type of power supply for producing a DC output signal including, for example as shown in FIG. 3, a rectifier 40A for converting an input AC signal into a DC signal and a capacitor 40B connected across rectifier 40A for regulating the rectifier output voltage.

A switch 38 controlled by a pulse-width modulation (PWM) controller 42 links power supply 40 to a node 39. A capacitor 35 couples the input to switch 38 to ground. A small resistor 41 links node 39 to one terminal of coil 34, a diode 44 links node 39 to ground. The other end of coil 34 is grounded.

An input control signal (INPUT) is driven high to tell controller 42 when relay 32 should close contacts 36 and is driven low to indicate when relay 32 is to open contacts 36. In response to a rising edge of the INPUT signal at time T0 (FIG. 4) controller 42 asserts a control signal PW telling switch 38 to close so that power supply 40 can apply a voltage across coil 34. Supply 40 begins delivering energy to coil 34, and the coil stores that energy in a magnetic field. The magnetic field intensity increase over time as the amount of energy stored in the field increases, and the current I passing though coil 34 increases in proportion to the intensity of the magnetic field. Controller 42 indirectly monitors the current I passing through coil 34 by monitoring a voltage $V_{REF}$ developed across resistor 41. $V_{REF}$ is proportional to I.

FIG. 4 is a timing diagram illustrating behavior of various signals of FIG. 3. Referring to FIGS. 3 and 4, at time T1, after the intensity of the magnetic field produced by coil 34 has risen somewhat above the minimum level needed to close contacts 36, the current I through coil 34 will have reached a level $I_{MAX}$. When controller 42 determines from $V_{REF}$ that current I has reached $I_{MAX}$, it drives PW low to open switch 38 so that after time T1, power supply 40 no longer supplies energy to coil 34. However the magnetic field surrounding coil 34 continues to induce current I through the loop including coil 34, diode 44 and resistor 41. Diode 44 acts as a switch to selectively provide a signal path for the coil current when the power supply 40 is not connected across the coil. (Diode 44 could be replaced with a switch controlled by controller 42.) The resistance of resistor 41 and the inherent resistances of diode 44 and coil 34 dissipate the energy stored in the magnetic field in proportion to the square of current I, thereby causing a decline in the intensity of the magnetic field and in the amplitude of current I.

At time T2, the current I through coil 34 falls to a level $I_{MIN}$, also somewhat higher than the current associated with the minimum magnetic field intensity needed to keep contacts closed. When controller 42 senses from $V_{REF}$ that the coil current I has fallen to $I_{MIN}$, it drives PW high again thereby re-closing switch 38 so that power supply 40 can resume supplying energy to coil 34. The magnitude of the magnetic field generated by coil 34 and the amplitude of current I again start to increase until controller 42 detects that the current has reached $I_{MAX}$ prompting controller 42 to open switch 38. As long as the INPUT signal remains high, controller 42 continues to pulse-width modulate the PW signal, opening and closing switch 38 as necessary to keep current I within the range [$I_{MIN}$, $I_{MAX}$]. At time T3, the INPUT signal is driven low to indicate that contacts 36 are to open again, controller 42 opens switch 38 and allows current I to fall to zero. Contacts 36 open when the amplitude of the magnetic field drops below the level needed to keep them closed.

When switch 38 is closed, system power loss is proportional to the sum of inherent resistances of supply 40, switch 38, resistor 41 and coil 34. These resistances can be minimized because they are not needed to limit the coil current. When switch 38 is open, system power loss is proportional to the sum of the relatively small inherent resistances of diode 44, resistor 41 and coil 34. Unlike the current-limiting resistor 24 of FIG. 2, resistor 41 of FIG. 3 is not sized to limit the current through coil 34. Resistor 41 allows controller 42 to sense the amplitude of coil current I and can have very low resistance so that it contributes relatively little to system power loss even when the amplitude of the current I controller 42 allows to pass through coil 34 is very high. Thus the only major sources of power loss are the inherent resistances of power supply 40, and that resistance dissipates power only when switch 38 is closed.

The optional capacitor 35 receives and stores a charge from power supply 40 when switch 38 is open and discharges to augment the current provided by supply 40 to coil 34 when switch 38 is closed. Thus capacitor 35 helps to smooth the current output of power supply 40, thereby reducing noise from those conductors and lowering the peak current power supply 40 must be capable of producing. In addition, since capacitor 35 reduces the current peaks in the conductors linking power supply 40 to switch 38, smaller conductors can be used. That is particular beneficial when switch 38 and capacitor 35 are mounted near coil 34 and distant from power supply 40, Comparing the relay control system 30 of FIG. 3 to switching power supply 28 of FIG. 2, note that relay control system 30 which applies voltage pulses to relay coil 34, includes a rectifier 40A and a switch 38 controlled by a PWM controller 42. Similarly, switching power supply 28 which applies voltage pulses across the primary winding of transformer 28E also includes a rectifier 28A and a switch 28C controlled by a PWM circuit 28D. However whereas PWM controller 28D of FIG. 2 controls the duty cycle of switch 28C to the power supply output voltage VS within a desired range, PWM controller 42 of FIG. 3 controls the duty cycle of switch 38 to keep coil current I within a desired range.

The invention eliminates overlapping functions of a switching power supply and a relay controller, thereby reducing the amount of hardware (including the expensive transformer 28E) needed to supply current to a relay coil over that required by prior art control system 25. Thus the invention not only reduces power losses in a relay control system, it can also reduce the cost of the control system by reducing the number of parts needed in the controller and by reducing the number of turns needed in the relay coil.

Timed Control of Non-Latching Relay

FIG. 5 is a schematic diagram illustrating a control system 50 in accordance with the invention for driving a normally open, non-latching relay 52 including a coil 54, contacts 56 and a diode 58 connected across coil 54. (Relay 52 could alternatively be a normally closed relay.) Control system 50 includes a switch 60 coupling a power supply 62 to one end of coil 54 and a controller 64 for generating a signal PW for controlling switch 60. The other end of coil 54 is grounded. An optional regulation capacitor 65 couples the input to switch 60 to ground. When an INPUT signal tells controller 64 that contacts 56 are to be closed, controller 64 begins to pulse-width modulate the PW signal with a controlled frequency and duty cycle, thereby causing switch 60 to intermittently connect power supply 62 to coil 54. Unlike feedback controller 42 of FIG. 3, controller 64 does not sense the current I passing though coil 54 to determine when to open and close switch 60; it simply opens and closes switch 60 at predetermined timed intervals.

FIG. 6 is a timing diagram illustrating behavior of various signals of relay control system 50 of FIG. 5. In response to a rising edge of an INPUT control signal at time T0, controller 64 begins to open and close switch 60 with a fixed frequency and duty cycle so that power supply 62 periodically supplies a pulse of energy to coil 54. Initially each energy pulse increases the amount of energy stored in the coil's magnetic field, thereby increasing the amplitude of the current I passing through coil 54. Between PW signal pulses, when switch 60 has disconnected power supply 62 from coil 54, the coil's magnetic field keeps the current flowing through the loop formed by coil 54 and diode 58. However the inherent resistances the coil and the diode dissipate some of the energy stored in the magnetic field, causing a continuous drop in current I.

Initially the drop in amplitude of current I between energy pulses is less than the rise in current amplitude caused by each energy pulse, and the amplitude of current I increases after controller 64 begins to pulse-width modulate the PW signal. However the coil current I will eventually reach a steady state range $[I_{MIN}, I_{MAX}]$ for which the energy dissipated by diode 58 and coil 54 while switch 60 is open will equal the energy added to the coil's magnetic field while switch 60 is closed. The coil current amplitude cannot increase beyond that level. At time T1, the INPUT signal tells controller 64 to open relay 52. Controller 64 then stops pulse-width modulating the PW signal, switch 60 remains open, and the amplitude of current I falls to zero as the inherent impedances of diode 58 and coil 54 dissipate all of the energy stored in the coil's magnetic field, thereby allowing contacts 56 to open.

The duty cycle of the PW signal controls the midpoint $I_{AVE}$ of the steady state current range while the frequency of the PW signal controls the width of the range $[I_{MIN}-I_{MAX}]$. Thus pulse-width modulation controller 64 sets the duty cycle and frequency of the PW signal so that the steady state range $[I_{MIN}, I_{MAX}]$ of the coil current resides above the minimum current coil 54 needs to maintain a magnetic field sufficient to close contacts 56.

The PWM controller 64 of FIG. 5 is less complicated than the feedback PWM controller 42 of FIG. 3; since the duty cycle of controller 64 is fixed, it does not have to provide feedback control. Controller 42 can be implemented as a simple oscillator selectively coupled to switch 60 in response to the INPUT signal. However the feedback controller 42 of FIG. 3 is advantageous in some applications because it permits coil current I to rise to its steady state value more quickly than controller 64, allowing relay 32 of FIG. 3 to operate more quickly than relay 52 of FIG. 5.

Timed Control of Series-connected Non-latching Relays

Figure 7:
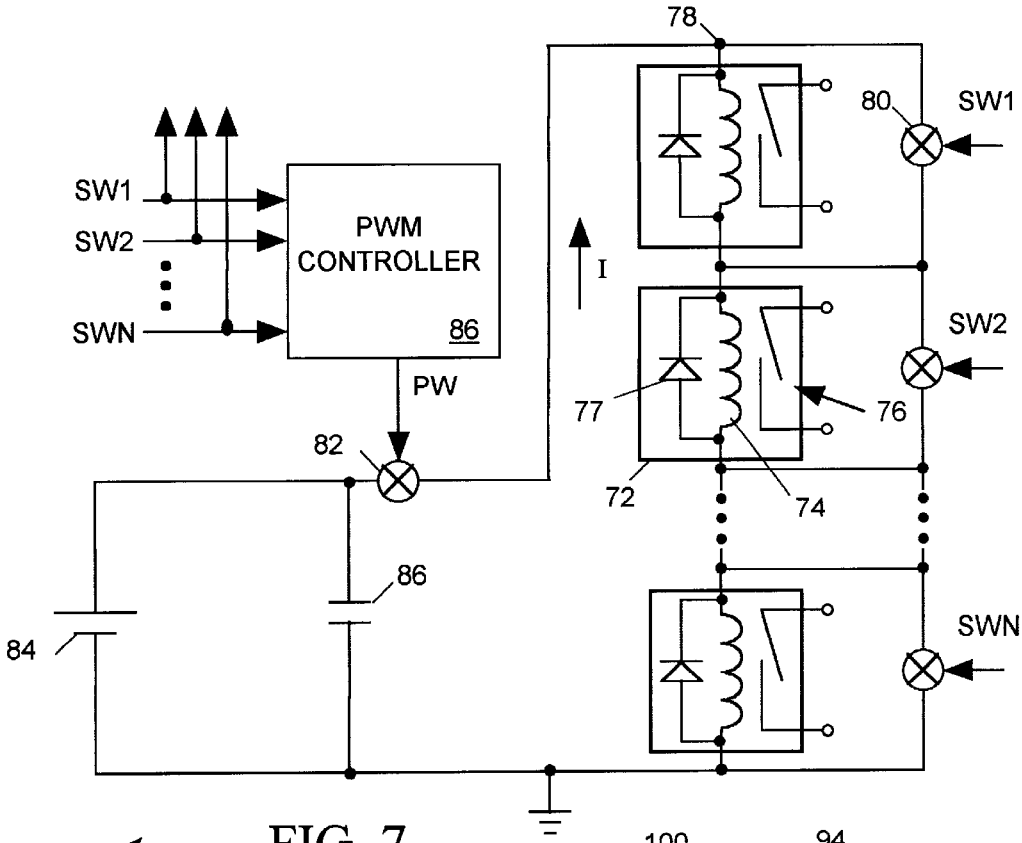

FIG. 7 is a schematic diagram illustrating a relay control circuit 70 in accordance with the invention for controlling a set of N non-latching, normally open relays 72, each relay having a coil 74, a pair of conductive contacts 76 and a diode 77 connected across the coil. (Relays 72 could be normally closed.) The coils 74 of relays 72 are connected in series between a circuit node 78 and ground. Relay control circuit 70 includes a switch 82 linking a power supply 84 to node 78, and a controller 86 for supplying a pulse-width modulated control signal PW input to switch 82. A regulating capacitor 86 links the input of switch 82 to ground. Control circuit 70 also includes a set of N switches 80, each connected across the coil 74 of a corresponding one of relays 72. A set of N externally generated signals SW1–SWN control switches 80.

Switches 80 are normally closed, thereby shorting coils 74 and preventing them from building up magnetic fields sufficient to close contacts 76. However when the contact 76 of any relay 72 is to be closed, the control signal input SW1–SWN of the switch 80 connected across that relay's coil 74 opens that switch 80 to allow current to pass through the corresponding relay coil 74. Controller 86 monitors the switch control signals SW1–SWN, and when they indicate that at least one relay contact is to be closed, controller 86 begins to pulse-width modulate the PW signal with a controlled frequency and duty cycle, thereby intermittently coupling power supply 84 to node 78.

As controller 86 pulse-width modulates the PW signal, power supply 84 supplies energy pulses to each coil 74 not currently shorted by a closed switch 80, and the unshorted coils are able to build up magnetic fields of sufficient intensity to close their corresponding relay contacts 76. The range $[I_{MIN}, I_{MAX}]$ of the steady state coil current I needed to keep contacts 76 of the unshorted relays 72 closed is the same regardless of the number of coils currently being energized. However the PW signal duty cycle needed to maintain the coil current I within that steady state range is a function of the number of coils being energized. Thus controller 86 monitors the SW1–SWN signals to determine how many coils are to be energized and adjusts the duty cycle of the PW signal accordingly.

Feedback Control of Series-connected, Non-latching Relays

Figure 8:
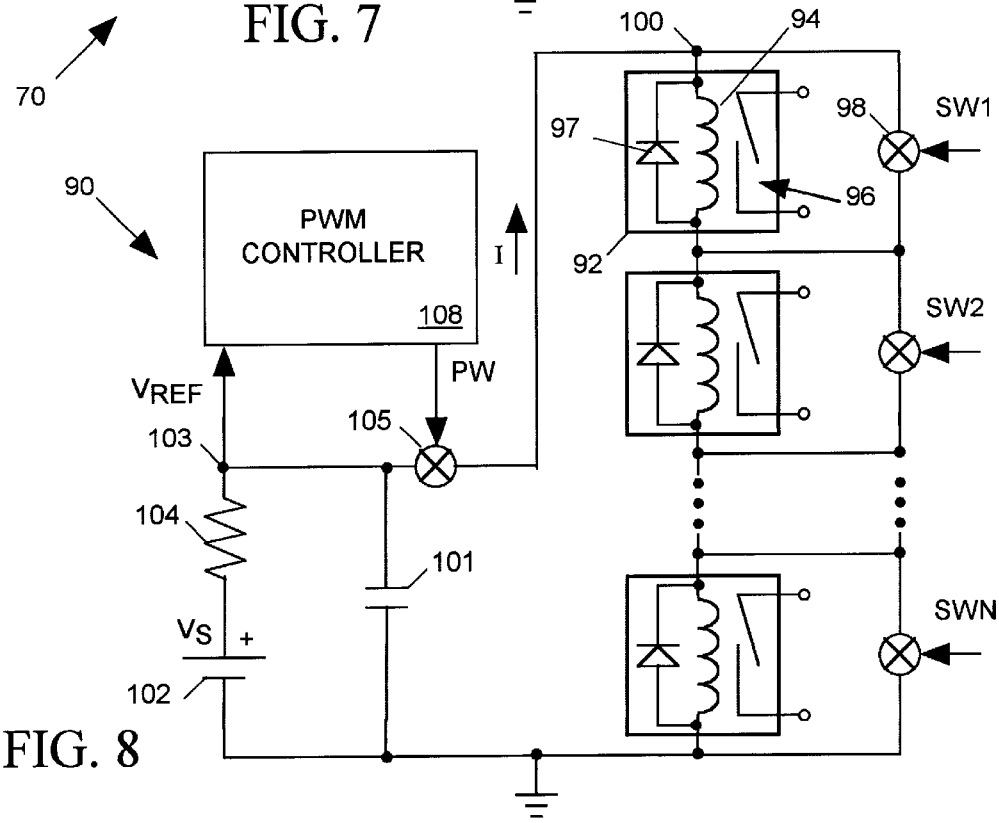

FIG. 8 is a schematic diagram illustrating a relay control system 90 in accordance with the invention for controlling a set of N non-latching relays 92. Each relay 92 includes a coil 94, contacts 96 and a diode 97 connected across the coil. All relay coils 94 are connected in series between a circuit node 100 and ground. Relay control system 90 includes a power supply 102 connected to a node 103 through a resistance 104, a switch 105 coupling node 103 to node 100, a pulse-width modulation controller 108 generating a signal PW for controlling switch 105, and a set of N switches 98, each connected across the coil 94 of a separate one of relays 92. A separate one of N control signals SW1–SWN controls each of switches 98. A regulating capacitor 101 couples the input of switch 105 to ground. The path resistance 104 models the sum of the output impedance of source 102 and the path resistance between source 102 and switch 105.

Controller 108 controls the frequency and duty cycle of the PW signal to keep the current I passing through the coils 94 not currently shorted by switches 98 within a steady state range $[I_{MIN}, I_{MAX}]$ wherein the unshorted coils are able to maintain magnetic fields of sufficient strength to keep contacts 96 closed. Controller 108 monitors a reference voltage $V_{REF}$ across capacitor 101, which is a measure of the amount of current being supplied to coils 94 when switch 105 is closed. The path resistance 104 causes a voltage drop in $V_{REF}$ that is proportional to the amplitude of current being supplied by source 102 when switch 105 is closed. When $V_{REF}$ falls to a level indicating that the coil current I has risen to $I_{MAX}$, controller 108 opens switch 105 and keeps it open for a predetermined amount of time sufficient for coil current to fall to $I_{MIN}$ before closing it again. Since the amount of time the coil current I requires to build up to $I_{MAX}$ depends on the number of coils 94 being energized, the amount of time controller 108 keeps switch 105 closed during each pulse-width modulation cycle varies with the number of coils 94 currently being energized. However since the amount of time required for the current in each coil to fall from $I_{MAX}$ to $I_{MIN}$ after switch 105 opens is independent of the number of coils currently being energized, the amount of time controller 108 keeps switch 105 open during each cycle is fixed and independent of the number of coils 94 being energized.

Feedback Control of Parallel-connected Non-latching Relays

FIG. 9 is a schematic diagram illustrating a relay control system 110 in accordance with the invention for driving a set of N parallel-connected, non-latching relays 112. Each relay 112 includes a coil 114, contacts 116, and a diode 118 connected across the coil. One end of each coil 114 is tied to a circuit node 120 and the other end of each coil is linked to ground through a corresponding one of a set of N switches 121. Relay control system 110 includes path resistance 122 linking a power supply 124 to a circuit node 126, a switch 128 linking node 126 to node 120, and a pulse-width modulation controller 129 producing an output signal PW for controlling switch 128. Resistance 122 includes the inherent resistances of power supply 124, of the signal path between power supply 124 and of switch 128. A regulating capacitor 127 couples the input of switch 128 to ground.

A set of signals SW1–SWN close each switch 121 when that switch's corresponding coil 114 is to be energized. Controller 129 pulse-width modulates the PW signal with a frequency and duty cycle sufficient to drive the current I passing through resistance 122 to a steady state range $M^*[I_{MIN}, I_{MAX}]$ where M represents the number coils 114 currently being energized. Controller 129 monitors the SW1–SWN signals to determine the number M of coils being energized and pulse-width modulates the PW signal to intermittently close switch 128 whenever M is greater than zero. Each time it closes switch 128, controller 129 monitors the voltage $V_{REF}$ at node 126, and when $V_{REF}$ falls to a level indicating that current I has risen to $M^*I_{MAX}$, controller 129 opens switch 128 for a fixed period of time sufficient to allow the current through each coil to fall to $I_{MIN}$. The rate at which coil currents fall to $I_{MIN}$ is independent of the number of coils being energized.

Timed Control of Parallel-connected Non-latching Relays

FIG. 10 is a schematic diagram illustrating a relay control system 130 in accordance with the invention for driving a set of N parallel-connected, non-latching relays 132. Each relay 132 includes a coil 134, contacts 136, and a diode 138 connected across the coil. One end of each coil 134 is tied to a circuit node 140 and the other end of each coil is linked to ground through a corresponding one of a set of N switches 142. Relay control system 130 includes a switch 148 linking a power supply 144 to circuit node 140, and a pulse-width modulation controller 149 for producing an output signal PW controlling switch 148. A regulating capacitor 141 couples the input of switch 148 to ground.

A set of externally generated signals SW1–SWN controlling switches 142 close each switch 142 when its corresponding coil 134 is to be energized. Controller 149 continuously pulse-width modulates the PW signal with fixed frequency and duty cycle regardless of the number of coils 134 currently being energized. The frequency and duty cycle of the PW signal are set to keep the current I passing through each coil 134 currently being energized within a steady state range $[I_{MIN}, I_{MAX}]$ providing a magnetic field sufficient to close its corresponding contact 136. The PW signal frequency and duty cycle needed to do that is independent of the number of coils 134 currently being energized.

Feedback Control of Latching Relay

FIG. 11 illustrates a system 150 in accordance with the invention for controlling a latching relay 152 including a coil 154 and contacts 156. Contacts 156 close when coil 154 produces a magnetic field pulse of one polarity and open when coil 154 produces a magnetic field pulse of an opposite polarity. No magnetic field is needed to keep contacts 156 either open or closed. Coil 154 is connected between a pair of circuit nodes 157 and 158. When an INPUT signal indicates contacts 156 are to close, control system 150 supplies a pulse-width modulated voltage across nodes 157 and 158 for a sufficient amount of time to allow coil 154 to produce a magnetic field of sufficient strength to close contacts 156. When the INPUT signal indicates contacts 156 are to open, control system 150 supplies a pulse- width modulated voltage of opposite polarity across nodes 157 and 158 for a sufficient amount of time to allow coil 154 to produce a magnetic field of sufficient strength to open contacts 156.

Control system 150 includes a set of four switches 161–164. Switch 161 links a node 168 to node 157, switch 162 links node 157 to ground, switch 163 links node 168 to node 158, and switch 164 links node 158 to ground. A regulating capacitor 165 couples node 168 to ground. Control system 150 also includes a power supply 167 linked through path resistance 166 to node 168 and a pulse-width modulation controller 169 supplying control signals PW1–PW4, respectively, to switches 161–164. Path resistance 166 models the internal impedance of supply 167 and the impedance of the conductors between supply 167 and node 168.

FIG. 12 is a timing diagram illustrating behavior of various signals of the circuit of FIG. 11. Referring to FIGS. 11 and 12, controller 169 normally sets PW1 and PW3 to keep switches 161 and 163 open and normally sets PW2 and PW4 to keep switches 162 and 164 closed. Thus coil 154 is normally shorted and does not produce a magnetic field.

When the INPUT signal goes high at time T0 to indicate contacts 156 are to close, controller 169 sets PW1 to close switch 161 and sets PW2 to open switch 162. Current I begins to flow through switches 161 and 164 and from node 157 to node 158 through coil 154. Controller 169 monitors a reference voltage $V_{REF}$ at node 168, and when at time T1 $V_{REF}$ has fallen to a level $V_{MIN}$ indicating coil current I has reached a level $I_{MAX}$, controller 169 sets PW1 to open switch 161 and sets PW2 to close switch 162. The magnetic field produced by coil 154 continues to cause current I to flow in the loop formed by coil 154 and switches 162 and 164, but the amplitude of coil current I falls as power losses in the inherent resistance of the loop remove energy from the magnetic field. At time T2, after a fixed delay sufficient to allow current I to fall to $I_{MIN}$, controller 169 sets PW1 and PW2 to close switch 161 and open switch 162. When $V_{REF}$ then falls once again at time T3 to $V_{MIN}$ as the coil current then rises again to $I_{MAX}$, controller 169 again opens switch 161 and closes switch 162. Thus controller 169 drives the coil current I to a steady state range $[I_{MIN}, I_{MAX}]$ for which the magnetic field is of sufficient intensity to close contacts 156 and maintains the coil within that range for a sufficient amount of time to allow the contacts to close. Thereafter (time T3) controller 169 closes switches 162 and opens switch 161 and allows the coil current I to fall to 0 at time T4. Since relay 152 is a latching relay, contacts 156 remain closed.

When at time T5 a falling edge of the INPUT signal indicates contacts 156 are to open, controller 169 closes switch 163 and opens switch 164 and allowing current I to pass from node 158 to node 157 through coil 154. When at time T6 current I has reached a level $-I_{MAX}$, controller 169 opens switch 163 and closes switch 162 thereby short circuiting coil 154. After allowing sufficient time for the coil current to reach a level $-I_{MIN}$ at time T7, controller 169 again closes switch 163 and opens switch 164 to allow I to return to $-I_{MAX}$. Controller 169 continues to pulse-width modulate the voltage across nodes 158 and 157 in this manner to keep the coil current in the range $[-I_{MIN},-I_{MAX}]$ until at time T8 contacts 156 have had sufficient time to open. Controller 169 then de-asserts PW3 and asserts PW4 to short coil 154 and allow the amplitude of coil current I to fall to 0. Since relay 152 is a latching relay, contacts 156 remain open.

Timed Control for Latching Relay

FIG. 13 illustrates a system 170 in accordance with the invention for controlling a latching relay 172 including a coil 174 and contacts 176. Coil 174 is connected between a pair of circuit nodes 177 and 178. Control system 170 includes a set of four switches 181–184. Switch 181 links a node 188 to node 177, switch 182 links node 177 to ground, switch 183 links node 188 to node 178, and switch 184 links node 178 to ground. A regulating capacitor 185 couples node 188 to ground. Control system 170 also includes a power supply 187 connected to node 188 and a pulse-width modulation controller 179 supplying control signals PW1–PW4, respectively, to switches 181–184. Controller 179 normally keeps switches 181 and 183 open and keeps switches 182 and 184 closed so that coil 174 is shorted.

When an INPUT signal is driven high to indicate contacts 176 are to close, controller 179 closes switch 181 and opens switch 182 thereby allowing a current I to pass from node 177 to node 178 through coil 174. After a fixed period of time controller 179 opens switch 181 and closes switch 182 to short circuit coil 174, thereby allowing the coil current amplitude to decline. After another fixed period of time, controller 179 re-closes switch 181 and reopens switch 182 to reconnect power supply 187 across nodes 177 and 178, thereby allowing the coil current to continue to increase. Controller 179 continues the process of periodically connecting power supply 187 across nodes 177 and 178 until the coil current I passing from node 177 to node 178 reaches a steady state range $[I_{MIN}, I_{MAX}]$ or which the magnetic field produced by coil 174 is of sufficient strength to close contacts 176. After allowing sufficient time for contacts 176 to close, controller 179 opens switch 181, closes switch 182, and allows the coil current to fall to 0.

When the INPUT signal is driven low to indicate contacts 176 are to open, controller 179 closes switch 183 and opens switch 184 thereby allowing a current I to pass from node 178 to node 177 through coil 174. After a fixed period of time controller 179 opens switch 183 and closes switch 184 to short circuit coil 174, thereby allowing the coil current amplitude to decline. After another fixed period of time, controller 179 re-closes switch 183 and re-opens switch 184 to reconnect power supply 187 across nodes 178 and 177, thereby allowing the coil current to continue to increase. Controller 179 continues the process of alternately opening and closing switches 183 and 184, periodically connecting power supply 187 across nodes 178 and 177 until the coil current I passing from node 178 to node 177 reaches a steady state range $[I_{MIN}, I_{MAX}]$ for which the magnetic field produced by coil 174 is of sufficient strength to open contacts 176. After allowing sufficient time for contacts 176 to open, controller 179 opens switch 183, closes switch 184, and allows the coil current to fall to 0.

The PWM controller 179 of FIG. 13 is less complicated than the feedback PWM controller 169 of FIG. 11, but feedback controller 169 permits coil current I to rise to its steady state value more quickly than controller 179. Thus relay 152 of FIG. 11 can operate more quickly than relay 172 of FIG. 13.

Control of Parallel-connected Latching Relays

FIG. 14 illustrates a circuit 190 in accordance with the invention for controlling a set of N latching relays 192, each including a coil 194 and contacts 196. One terminal of each coil 194 is connected to a circuit node 197. A separate one of a set of N switches 195 controlled by control signals connects the other terminal of each coil 195 to a circuit node 198. Control system 190 includes a set of four switches 201–204. Switch 201 links a node 208 to node 197, switch 202 links node 197 to ground, switch 203 links node 208 to node 198, and switch 204 links node 198 to ground. A regulating capacitor 210 couples node 208 to ground.

Control system 190 also includes a power supply 207 connected to node 208 and a pulse-width modulation controller 209 supplying control signals PW1–PW4, respectively, to switches 201–204 and for supplying control signals SW1–SWN to switches 195. Controller 209 normally keeps switches 195 closed, keeps switches 201 and 203 open, and keeps switches 202 and 204 closed so that all coils 194 are short-circuited. Each of a set of N input signals IN1–INN to controller 209 is driven high to indicate when the contacts 196 of a corresponding one of relays 192 is to close and is driven low to indicate when the contacts are to open.

When one or more of the IN1–INN signals are concurrently driven high to indicate contacts 196 of one or more relays 192 are to close, controller 209 closes the switches 195 corresponding to all relays 192 that are to remain open. Controller 209 also closes switch 201 and opens switch 202, thereby connecting power supply 207 across nodes 197 and 198 and allowing currents to pass through coils from node 197 to node 198 via closed switches 195. After a fixed period of time, controller 209 opens switch 201 and closes switch 202 to short circuit coils 194, thereby allowing coil current amplitudes to decline. After another fixed period of time, controller 209 re-closes switch 201 and re-opens switch 202 to reconnect power supply 207 across nodes 197 and 198, thereby allowing the coil currents to continue to increase. Controller 209 continues the process of periodically connecting power supply 207 across nodes 197 and 198 until the coil current passing from node 197 to node 198 through each coil 194 linked to a closed switch 195 reaches a steady state range $[I_{MIN}, I_{MAX}]$ for which the magnetic fields produced by those coils 194 are of sufficient intensity to close the coil's contacts 196. After allowing sufficient time for those contacts 196 to close, controller 209 opens switch 201, closes switch 202, closes all switches 195 that are open, and allows all coil currents to fall to 0.

When one or more of the IN1–INN signals are concurrently driven low to indicate contacts 196 of one or more relays 194 are to open, controller 209 closes the switches 195 corresponding to all relays 192 that are to remain closed. Controller 209 also closes switch 203 and opens switch 202, thereby connecting power supply 207 across nodes 198 and 197 and allowing a current I to pass through coils from node 198 to node 197 via closed switches 195. After a fixed period of time, controller 209 opens switch 203 and closes switch 204 to short circuit coils 194, thereby allowing the coil current amplitudes to decline. After another fixed period of time, controller 209 re-closes switch 203 and reopens switch 204 to reconnect power supply 207 across nodes 198 and 197, thereby allowing the coil currents to continue to increase. Controller 209 continues the process of periodically connecting power supply 207 across nodes 198 and 197 until the coil currents I passing from node 198 to node 197 through each coil 194 linked to a closed switch 195 reaches a steady state range $[I_{MIN}, I_{MAX}]$ for which the magnetic fields produced by those coils 194 are of sufficient intensity to open the coil's contacts 196. After allowing sufficient time for those contacts 196 to open, controller 209 opens switch 203, closes switch 204, closes all switches 195 that are open, and allows all coil currents to return to 0.

While PWM controller 209 pulse-width modulates the connection of power supply 207 to node 197 or node 198 with a fixed duty cycle and frequency when opening or closing contacts 198, controller 209 could be adapted to use feedback to control the length of time it keeps power supply 207 connected across nodes 197 and 198 during each cycle, in the manner employed by controller 169 of FIG. 11. In such case controller 209 would monitor the voltage at node 208 and disconnect power supply 207 from node 197 or 198 whenever that voltage falls to a level indicating that the current into node 208 has reached a level $M*I_{MAX}$ where M is the number of coils 194 currently being energized. Although the timing between switch operations is controlled differently, the switch control sequencing would be the same for the feedback version of the PWM controller as for timed version of the controller.

Control of Series-connected Latching Relays

FIG. 15 illustrates a circuit 220 in accordance with the invention for controlling a set of N latching relays 222, each including a coil 224 and contacts 226. All coils 224 are connected in series between a pair of circuit nodes 227 and 228. Each of a set of N switches 225 controlled by control signals SW1–SWN is connected across the coil 224 of a corresponding one of relays 222. Control system 220 includes a set of four switches 231–234. Switch 231 links a node 238 to node 227, switch 232 links node 227 to ground, switch 233 links node 238 to node 228, and switch 234 links node 228 to ground.

Control system 220 also includes a power supply 237 connected to node 238 through a resistance 240, the sum of the output impedance of power supply 237 and the path impedance between supply 237 and node 238. A pulse-width modulation controller 239 supplying control signals PW1–PW4, respectively, to switches 231–234 and supplies control signals SW1–SWN to switches 225. Controller 239 normally keeps switches 225 closed so that all coils 224 are short-circuited and keeps switches 231–234 open to disconnect supply 237 from nodes 227 and 228. Each of a set of N input signals IN1–INN to controller 239 is driven high to indicate when the contracts 226 of a corresponding one of relays 222 is to close and is driven low to indicate when the contacts are to open.

When one or more of the IN1–INN signals are concurrently driven high to indicate contacts 226 of one or more relays 222 are to close, controller 239 sets signals SW1–SWN to open the switches 225 connected across the coils of the relays 222 that are to close their contacts 226, while keeping the switches 225 connected across all other relays 222 closed. At the same time, controller 239 closes switches 231 and 234, and opens switch 232, thereby connecting power supply 237 across nodes 227 and 228 and allowing a current I to pass from node 227 to node 228 through the coils 224 of the relays 222 not currently shunted by switches 225. Controller 239 monitors a reference voltage $V_{REF}$ produced at node 238 and when $V_{REF}$ falls to a level indicating the coil current I has reached $I_{MAX}$, controller 239 opens switch 231 and closes all open switches 225 to short circuit all coils 224, thereby allowing the coil currents to decline in amplitude. After allowing a fixed period of time for the coil currents to decline, controller 239 re-closes switch 231 and opens the switches 225 corresponding to the relays 222 that are to close their contacts, thereby allowing the coil current in those relays to continue to increase. Controller 239 continues the process of alternately connecting power supply 237 to node 227 and shorting coils 224 until the coil current I passing through the coils 224 being energized reaches a steady state range $[I_{MIN}, I_{MAX}]$ for which the magnetic fields produced by those coils are sufficient to close the coils' contacts 226. After allowing sufficient time for those contacts 226 to close, controller 239 opens switch 231 and closes all switches 225 that are open to allow the coil currents to fall to 0.

When one or more of the IN1–INN signals are concurrently driven low to indicate contacts 226 of one or more relays 222 are to open, controller 239 sets signals SW1–SWN to open the switches 225 connected across the coils of the relays 222 that are to open their contacts 226, while keeping the switches 225 connected across all other relays 222 closed. At the same time, controller 239 closes switches 232 and 233, and opens switch 234, thereby connecting power supply 237 across nodes 228 and 227 and allowing a current I to pass from node 228 to node 227 through the coils 224 of the relays 222 not currently shunted by switches 225. When $V_{REF}$ falls to a level indicating the coil current I has reached $I_{MAX}$, controller 239 opens switch 233 and closes all open switches 225 to short circuit all coils 224, thereby allowing the coil currents to decline in amplitude. After allowing a fixed period of time for the coil currents to decline, controller 239 re-closes switch 233 and opens the switches 225 corresponding to the relays 222 that are to open their contacts, thereby allowing the coil current in those relays to continue to increase. Controller 239 continues the process of alternately connecting power supply 237 to node 228 and shorting coils 224 until the coil current I passing through the coils 224 being energized reaches a steady state range $[I_{MIN}, I_{MAX}]$ for which the magnetic fields produced by those coils are sufficient to open the coils' contacts 226. After allowing sufficient time for those contacts 226 to open, controller 239 opens switch 233 and closes all switches 225 that are open to allow the coil currents to fall to 0.

While PWM controller 239 pulse-width modulates the connection of power supply 237 to node 227 or node 228 with a feedback controlled duty cycle and frequency, controller 239 could be adapted to provide a fixed duty cycle. In such case controller 239 need not monitor $V_{REF}$. However since the duty cycle needed to drive the coil current to the appropriate range depends on the number of coils currently being energized, a fixed-duty cycle controller 239 would adjust the fixed duty cycle with which it connects the power supply to node 227 or 228 while coils are being energized to account for the number of coils being energized.

The forgoing specification and the drawings depict the best mode(s) of practicing the invention, and elements or steps of the depicted best mode(s) exemplify the elements or steps of the invention as recited in the appended claims. However the appended claims are intended to apply to any mode of practicing the invention comprising the combination of elements or steps as described in any one of the claims, including elements or steps that are functional equivalents of the example elements or steps depicted in the specification and drawings. For example, while relay controllers in accordance with the invention have been described herein above as being useful for controlling a prior art reed relays as illustrated in FIG. 1, many other kinds of prior art relays employ coils to produce magnetic fields which actuate other types contacts. Hence, those of skill in the art will appreciate that a controller in accordance with the invention can be used for controlling a wide variety of relays.

Accordingly should any appended claim describe an element or step only in terms of its function, then it is intended that the claim's description of the element be interpreted as reading on any element or step having the described function, regardless of any structural limitations associated with any example depicted in this specification or in the drawings.

What is claimed is:

1. An apparatus for providing a signal path between circuit nodes in response to a first control signal, the apparatus comprising:

contacts for closing to provide the signal path between the circuit nodes and for opening to break the signal path between the circuit nodes selectively in response to a magnetic field;

a coil for supplying the magnetic field to the contacts with an intensity proportional to a amplitude of a current passing through the coil; and first means for applying a pulsed signal across the coil in response to the first control signal, wherein the pulsed signal intermittently applies a voltage across that coil producing a current in the coil of amplitude rising to a steady state range that is a function of a duty cycle of the pulsed signal.

2. The apparatus in accordance with claim 1 further comprising switch means for shorting the coil during times when the pulsed signal is not applying the voltage across the coil.

3. The apparatus in accordance with claim 1 wherein the switch means comprises a diode.

4. The apparatus in accordance with claim 1 wherein the first means comprises switch means connected across the coil for short circuiting the coil between pulses of said pulsed signal.

5. The apparatus in accordance with claim 1 wherein the first means monitors the current passing through the coil when applying the pulsed signal across the coil and adjusts the duty cycle of the pulsed signal to prevent the amplitude of the current from rising above the steady state range.

6. The apparatus in accordance with claim 1 wherein the first means monitors a voltage amplitude of each pulse of the pulsed signal and stops generating the pulse when the pulse's voltage amplitude reaches a predetermined limit.

7. The apparatus in accordance with claim 1 wherein the pulsed signal has a fixed duty cycle.

8. The apparatus in accordance with claim 1 wherein the first means comprise:

a power supply;

second means for linking the power supply to the coil in response to a second control signal; and third means for repeatedly asserting the second control signal in response to the first control signal.

9. The apparatus in accordance with claim 8 wherein the third control means repeatedly asserts the second control signal with a duty cycle adjusted in feedback response to a voltage amplitude of pulses of the pulsed signal.

10. The apparatus in accordance with claim 8 wherein the third control means repeatedly asserts the second control signal with a fixed duty cycle in response to the first control signal.

11. The apparatus in accordance with claim 1 wherein the contacts make the signal path between the nodes when the coil supplies the magnetic field, and wherein the contacts break the signal path between the nodes when the coil stops supplying the magnetic field.

12. The apparatus in accordance with claim 1 wherein the contacts break the signal path between the nodes when the coil supplies the magnetic field, and wherein the contacts make the signal path between the nodes when the coil stops supplying the magnetic field.

13. The apparatus in accordance with claim 1 wherein the contacts make the signal path between the nodes when the coil supplies the magnetic field of a first field polarity, wherein the contacts break the signal path between the nodes when the coil supplies the magnetic field of a second field polarity opposite to that of the first field polarity.

14. The apparatus in accordance with claim 1 wherein the contacts make the signal path between the nodes when the coil supplies the magnetic field of a first field polarity, wherein the contacts break the signal path between the nodes when the coil supplies the magnetic field of a second field polarity opposite to that of the first field polarity.

15. The apparatus in accordance with claim 14 wherein the first means applies the pulsed signal across the coil with a first voltage polarity when the contacts are to close such that the current passes through the coil in a first direction, and such that the coil generates the magnetic field of the first field polarity, and wherein the first means applies the pulsed signal across the coil with a second voltage polarity opposite to the first polarity when the contacts are to open such that the current passes through the coil in a second direction, and such that the coil generates the magnetic field of the second field polarity.

16. The apparatus in accordance with claim 15 wherein the first means comprises:

a power supply;

a switch network; and control means for supplying switch control signals to the switch network causing the switch network to intermittently connect the power supply across the coil with said first voltage polarity when the first control signal indicates the contacts are to close, and causing the switch network to intermittently connect the power supply across the coil with said second voltage polarity when first control signal indicates the contacts are to open.

17. The apparatus in accordance with claim 16 wherein switch network comprises:

a first node, a second node, a third node, a fourth node, a first switch selectively linking the first and third nodes in response to a first switch control signal, a second switch selectively linking the second and third nodes in response to a second switch control signal, a third switch selectively linking the first and third nodes in response to a first switch control signal, a fourth switch third linking the second and fourth nodes in response to a fourth switch control signal, wherein the power supply is connected across the first and second nodes, and wherein the coil is connected between the third and fourth nodes.

18. The apparatus in accordance with claim 1 wherein the first means comprises:

a resistor connected in series with the coil, a diode connected across the resistor and the coil;

a power supply, a switch for selectively connecting the power supply across the series-connected resistor and coil in response to pulses of a second control signal, and second means responding to the first control signal by pulse-width modulating the second control signal with a duty cycle controlled by a reference voltage appearing across the resistor.

19. The apparatus in accordance with claim 1 wherein the first means compresses:

a diode connected across the coil, a power supply, a switch for selectively connecting the power supply across the coil in response to pulses of a second control signal, and second means for responding to the first control signal by pulse-width modulating the second control signal with a fixed duty cycle.

20. An apparatus for selectively providing signal paths between circuit nodes, the apparatus comprising:

a plurality of contacts, each for closing to make the signal path between the circuit nodes and for opening to break the signal path between the circuit nodes selectively in response to a separate magnetic field;

a plurality of coils, each corresponding to a separate one of the contacts, each coil for providing a separate magnetic field to its corresponding contact, the magnetic field having an intensity proportional to a amplitude of a current passing through the coil; and first means for applying a pulsed signal across any selected subset of the coils, wherein the pulsed signal produces a current in each coil of amplitude rising to a steady state range that is a function of a duty cycle of the pulsed signal.

21. The apparatus in accordance with claim 20 wherein the first means connects the coils of the selected subset in parallel and applies the pulsed signal in parallel across each coil of the selected subset.

22. The apparatus in accordance with claim 20 wherein the first means connects the coils of the selected subset in series and applies the pulsed signal across the series of coils of the selected subset.

23. The apparatus in accordance with claim 20 wherein each of the contacts makes its signal path when the coil supplies the magnetic field, and wherein of the contacts breaks its signal path when the coil stops supplying the magnetic field.

24. The apparatus in accordance with claim 20 wherein each of the contacts breaks its signal path when the coil supplies the magnetic field, and wherein each of the contact makes the signal path between the nodes when the coil stops supplying the magnetic field.

25. The apparatus in accordance with claim 20 wherein each of the contacts makes its signal path when its corresponding coil produces its magnetic field of a first field polarity, and wherein each of the contacts breaks its signal path when its corresponding coil produces the magnetic field of a second field polarity opposite to that of the first field polarity.

26. The apparatus in accordance with claim 25 wherein the first means applies the pulsed signal with a first voltage polarity across the coils of the selected subset when their corresponding contacts are to make their signal paths such that current passes through each coil of the selected subset in a first direction such that the coil generates the magnetic field of the first field polarity, and wherein the first means applies the pulsed signal with a second voltage polarity opposite to the first polarity across the coils of the selected subset when their corresponding contacts are to break their signal paths such that the current passes through each coil of the selected subset in a second direction such that the coil generates the magnetic field of the second field polarity.

27. The apparatus in accordance with claim 26 wherein the plurality of coils are connected in series to form a series of coils, and wherein the first means comprises:

a plurality of switches, each for selectively shorting a separate one of the coils in response to a separate one of a plurality of first switch control signals;

a power supply;

a switch network for intermittently connecting the power supply across the series of coils with selectively either of said first voltage polarity and second voltage polarity in response to a plurality of second switch control signals supplied as input to the switch network, and control means for producing the first and second switch for selectively shoring ones of the coils and for causing the switch network to intermittently connect the power supply across the series of coil with a selected one of said first and second voltage polarities.

28. The apparatus in accordance with claim 27 wherein switch network comprises:

a first node, a second node, a third node, a fourth node, a first switch selectively linking the first and third nodes in response to a first switch control signal, a second switch selectively linking the second and third nodes in response to a second switch control signal, a third switch selectively linking the first and third nodes in response to a first switch control signal, a fourth switch third linking the second and fourth nodes in response to a fourth switch control signal, wherein the power supply is connected across the first and second nodes, and wherein the series of coils is connected between the third and fourth nodes.

29. The apparatus in accordance with claim 20 wherein the first means comprises:

a first node, a second node, a third node, a fourth node, a first switch selectively linking the first and third nodes, a second switch selectively linking the second and third nodes, a third switch selectively linking the first and third nodes, a fourth switch third linking the second and fourth nodes, a plurality of fifth switches, each corresponding to a separate one of the coils, wherein each fifth switch and its corresponding coil is connected in series between the third and fourth nodes, and a power supply connected across the first and second nodes.

30. The apparatus in accordance with claim 20 wherein the first means comprises:

a first node, a second node, the coils being connected in series between the first and second nodes, a power supply, switch means for selectively coupling the power supply across the first and second nodes, and a plurality of switches, each being connected across a corresponding one of the coils for selectively shorting the corresponding coil.

31. The apparatus in accordance with claim 20 wherein the first means comprises:

a first node, a second node, a power supply, switch means for intermittently coupling the power supply across the first and second nodes, and a plurality of switches, each being connected in series with a separate one of the coils between the first and second nodes.

32. A method for controlling a relay having contacts and a coil for producing a magnetic field for operating the contacts, the method comprising the steps of:

a. connecting a voltage source across the coil, b. concurrently disconnecting the voltage source from across the coil and shorting the coil, and c. repeating steps a and b to until a current developed in the coil rises to a steady state amplitude range that is a function of a duty cycle with which the voltage source is connected across the coil, wherein the coil produces said magnetic field of sufficient intensity to operate the contacts.

33. The method in accordance with claim 32 further comprising the steps of:

d. monitoring a voltage produced by the voltage source across the coil, and e. controlling said duty-cycle in response to the monitored voltage.

34. The method in accordance with claim 32 further comprising the steps of:

c. monitoring the current in the coil, and d. controlling said duty-cycle to keep the monitored current within the steady state amplitude range.

35. The method in accordance with claim 32 wherein the duty cycle is fixed.

* * * * *